United States Patent [19]

Pardo

[11] Patent Number: 4,757,484

[45] Date of Patent: Jul. 12, 1988

[54] MAYAN SYMBOL-BEARING CLOCK DEVICE

[76] Inventor: Carlos A. Pardo, 413 West Elmwood, Burbank, Calif. 91506

[21] Appl. No.: 30,661

[22] Filed: Mar. 27, 1987

[51] Int. Cl.[4] ..... G04B 19/00

[52] U.S. Cl. ..... 368/223; 368/241

[58] Field of Search ..... 368/235, 223, 225, 227, 368/229, 241, 242

[56] References Cited

U.S. PATENT DOCUMENTS

| | | | |
|---|---|---|---|
| 3,273,139 | 9/1966 | Flactiff et al. | 368/223 |
| 4,206,458 | 6/1980 | Sado | 368/239 |
| 4,253,171 | 2/1981 | Grinwald | 368/227 |

FOREIGN PATENT DOCUMENTS

| | | | |
|---|---|---|---|
| 2346442 | 4/1975 | Fed. Rep. of Germany | 368/223 |
| 3320082 | 3/1984 | Fed. Rep. of Germany | 368/239 |
| 10471 | 1/1978 | Japan | 368/223 |
| 77493 | 7/1978 | Japan | 368/239 |

*Primary Examiner*—Bernard Roskoski

*Attorney, Agent, or Firm*—John J. Posta, Jr.

[57] ABSTRACT

The clock device has a hollow housing bearing readily viewable adjacent first, second and illuminatable display panels, the first panel bearing the hour indicator and an inverted V indicating zero, four dots indicating ones and two horizontal bars each indicating five, the second panel being the tens of minutes indicator and bearing four dots and one horizontal bar, while the fifth panel is the minutes indicator and bears an inverted V, four dots and one horizontal bar. A power supply such as electrical house current or a battery is disposed in the housing, connected to a clock timing mechanism and a signal generator which is, in turn, connected to symbol-illuminating incandescent bulbs, liquid crystal display components and/or light emitting diodes in the panels. The device can also include a similar temperature measuring and display mechanism, with separate fourth, fifth and sixth display panels bearing mayan symbols, and + and − symbols, with switches to cause the device to alternately or simultaneously display the time and temperature. Alternatively, the temperature display can be made on the first three panels.

10 Claims, 1 Drawing Sheet

MAYAN SYMBOL-BEARING CLOCK DEVICE

BACKGROUND OF THE INVENTION

1. Field of the Invention

The present invention generally relates to timing devices and, more particularly, to a novel mayan symbol-bearing clock device.

2. Prior Art

Various forms of time pieces have been devised. Certain of such time devices display the time in other than Roman or Arabic numerals. For example, certain watches merely indicate the hours by identical single slashes or dots, or the like, their spaced positions around the watch face denoting their value. Other clocks utilize special symbols, such as the peculiar ones displayed in U.S. Design Pat. No. 152,199 and apparently representing apothecary denotations. In U.S. Design Pat. No. 81,040 geometrical symbols are used as time indicators. Both those patents employ a separate single symbol for each hour position around the clock face. U.S. Design Pat. No. 244,835 and its corresponding Utility Pat. No. 4,030,285, employ three hour glass designs, the designs bearing in each of their upper and lower halves, respectively, 10, 6 and 12—illuminatable instable dots so that some dots are always illuminated, in the upper and/or lower hour glass halves, presumably for a unique display appearance.

There remains a need for a novel, attractive time display device which, if desired, can also be used to indicate temperature and which employs symbols and sequences totally different from the known prior art. Such device should be simple, efficient and durable and capable of being fabricated in a variety of sizes, shapes and modes.

SUMMARY OF THE INVENTION

All the foregoing needs are satisfied by the novel mayan symbol-bearing clock device of the present invention. The device is substantially as set forth in the Abstract. Thus, the device comprises a hollow housing bearing three adjacent display panels having illuminatable mayan symbols to indicate the hour and minutes. The housing contains an electrical power source such as a battery or a house current line connected to a clock timing mechanism and a symbol generator, responding to the clock timing mechanism. The generator is, in turn, connected to means such as incandescent bulbs, LCD's or LED's for illuminating the mayan symbols. The device can also include an inter-connected temperature sensing mechanism and signal generator, the latter being connected to the described illuminatable means in the three display panels or to a separate set of illuminatable means in three other display panels in the housing bearing mayan symbols. Switch means may be provided for alternately or simultaneously displaying the time and temperature. The device is novel, attractive, compact, durable and inexpensive. Further features of the device are set forth in the following detailed description and accompanying drawings.

DRAWINGS

FIG. 1 is a schematic front elevation, partly broken away, of a first preferred embodiment of the mayan symbol-bearing clock device of the present invention, shown with a three panel display arrangement; and, FIG. 2 is a schematic front elevation, partly broken away, of a second preferred embodiment of the mayan symbol-bearing clock device of the present invention, shown with a six panel display arrangement.

DETAILED DESCRIPTION

FIG. 1

Figure 1:
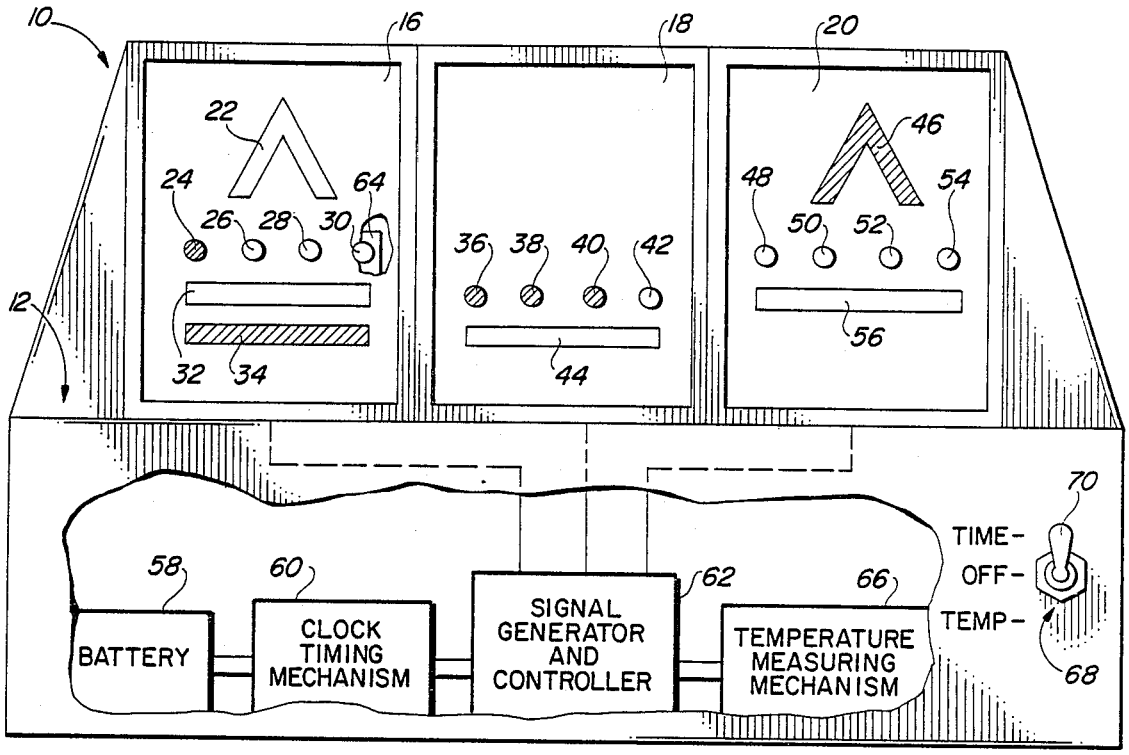

Now referring to FIG. 1 of the drawings, a first preferred embodiment of the novel mayan symbol-bearing clock device of the present invention is schematically depicted therein. Thus, device 10 is shown which comprises a hollow clock housing 12 having on the upper portion 14 thereof three adjacent readily viewable display panels 16, 18 and 20.

Panel 16 is the hour panel and bears the following illuminatable mayan symbols: an inverted V designated 22 in FIG. 1 to represent zero, four dots 24, 26, 28 and 30 to represent ones and two horizontal bars 32 and 34 to represent fives. Thus, the symbols in panel 16 cover the hour range of 0 to 12. Panel 18 is the tens of minutes panel and bears the following illuminatable mayan symbols: four dots 36, 38, 40 and 42 and one horizontal bar 44. Panel 20 is the minutes panel and bears the following illuminatable mayan symbols: an inverted V 46, four dots 48, 50, 52 and 54 and one horizontal bar 56. All bars in the three panels have a value of five and all dots have a value of one. All inverted V's have a value of zero. Panels 18 and 20 are read together to indicate the minutes, panel 18 representing the first digit and panel 20 the second digit. The shading of bar 34 and dot 24 in FIG. 1 indicates they are illuminated and thus the hour shown in FIG. 1 is six, while dots 36, 38 and 40 are illuminated in panel 18, indicating 30, while the inverted V-46 is illuminated in panel 20 to indicate zero. The time therefore is 6:30. It will be understood that the described mayan symbols can be provided by cutting out the appropriate portions of panels 16, 18 and 20 and leaving them open or resurfacing them with a transparent material (not shown).

Housing 12 is hollow and contains an electrical power source in the form of an electrical battery 58 powering a coventional electrical clock timing mechanism 60, or the like, in turn electrically connected to and controlling a conventional electrical signal generator 62 which provides an electrical signal output to each of the light-emitting diodes 64 positioned behind each of the mayan symbols in panels 16, 18 and 20 to display that temperature. Conventional electrical switch means 68 are connected to signal generator 62 to regulate what display, either time or temperature, is to be shown in panels 16, 18 and 20 at any given time. Such means include a three-position flip lever 70 having a time position, an off position and a temperature position mounted on the outside of housing 12. It will be understood that housing 12 can be in any desired shape or form and that in place of battery 58 an electrical lead to an electrical house current source can be used, together with an AC-DC converter. Device 10 is simple, inexpensive, durable, efficient and attractive. It provides a novel appearance and function.

FIG. 2

Figure 2:
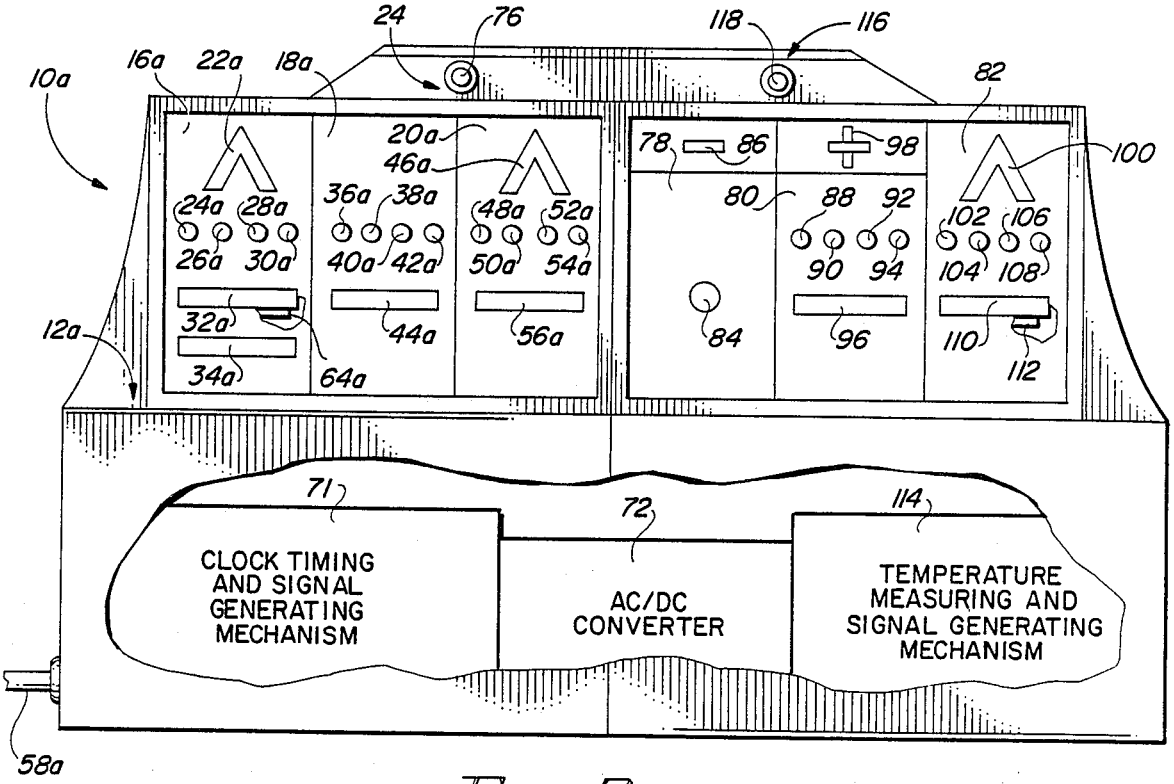

A second preferred embodiment of the novel mayan symbol-bearing clock device of the present invention is schematically depicted in FIG. 2. Thus, device **10*a* is shown. Components thereof similar to those of device 10 bear the same numerals but are succeeded by the letter "a". Device 10*a* is substantially identical to device 10** except that the clock timing and clock signal generating functions are handled by one mechanism and temperature measuring and temperature signal generating mechanisms are handled by a second mechanism. Moreover, separate sets of display panels and mayan symbols are used for the time and temperature functions. In addition, device 10*a* is powered by an electfical house current and utilizes an AC-to-DC converter.

Thus, device 10*a* includes housing 12*a*, display panels 16*a*, 18*a* and 20*a* devoted exclusively to time display, with mayan symbols 22*a*, 24*a*, 26*a*, 28*a*, 30*a*, 34*a*, 36*a*, 38*a*, 40*a*, 42*a*, 44*a*, 46*a*, 48*a*, 50*a*, 52*a*, 54*a*, and 56*a* illuminated by separate incandescent lamps 64*a* electrically interconnected to a clock timing and signal generating mechanism 71 combining the functions of items 60 and 62 of FIG. 1 and powered by electrical housing current through input line 58*a* passing through AC-DC converter 72. A switch 74 electrically connects to mechanism 71 to enable the time to be displayed when switch button 76 is depressed. The temperature is measured, displayed by means substantially identical to and parallel to those of the described clock timing and display system, in adjacent panels 78, 80 and 82, panel 78 housing the mayan symbol of a dot 84 and the minus sign 86, panel 80 having the mayan symbols of four dots 88, 90, 92 and 94, a horizontal bar 96 and a plus sign 98, and panel 82 having the mayan symbols of an inverted V 100, four dots 102, 104, 106 and 108 and a horizontal bar 110. Thus, the mayan symbols and plus and means signs of panels 78, 80 and 82 can be illuminated, as by incandescent lamps 112, to depict temperatures between −199° and +199°*F*. It will be understood that this range is only illustrative and that panels 78, 80 and 82 could bear mayan symbols capable of depicting another temperature range, e.g., −50°+130°*F* or the like.

Lamps 112 are electrically interconnected to temperature measuring and signal generating mechanism 114 combining the functions of items 62 and 66 of FIG. 1 and powered by electrical current from input line 58*a* through AC-DC converter 72. Switch 116 electrically connects to mechanism 114 to enable the temperature to be displayed when switch button 118 is depressed. Switches 74 and 116 thus prolong the life of lamps 64*a* and 112 while permitting an instant read-out of the time and/or temperature. Accordingly, device 10*a* is similar to device 10 in operation and advantages.

Various other modifications, changes, alterations and additions as are within the scope of the appended claims form part of the present invention. All such modifications, changes, alterations and additions as are within the scope of the appended claims form part of the present invention.

What is claimed is:

1. A clock device for displaying the time of day using Mayan symbols, comprising, in combination:

(a) a hollow clock housing having readily viewable, adjacent first, second and third display panels, each of which bear thereon electrically illuminatable means bearing Mayan symbols for denoting numerical values, (b) said first panel including four rows of symbols, in which (1) the first row contains an inverted V symbol to denote zero, (2) the second row contains four dots, with each dot denoting a numerical value of one, (3) the third row contains a single horizontal bar denoting a numerical value of five , and (4) the fourth row contains a single horizontal bar denoting a numerical value of five, whereby said first display panel is capable of denoting the hour from zero to twelve, and (c) said second panel including two rows of symbols in which, (1) the first row contains four dots with each dot denoting a numerical value of one, and (2) the second row contains a single horizontal bar denoting a numerical value of five, and (d) said third panel including three rows of figures in which, (1) the first row contains an inverted V symbol to denote zero, (2) the second row contains four dots with each dot denoting a numerical value of one, and (3) a third row contains a single horizontal bar denoting a numerical value of five, whereby said second and third panels are capable of together denoting seconds from zero to fifty-nine, (e) electrical power means for activating said illuminatable means, (f) a clock timing mechanism connected to and powered by said power means, and (g) an electric signal generator connected to and generating signals in response to said clock timing mechanism, said generator also being connected to said power source and said illuminatable means for selectively lighting said illuminatable means and thereby said symbols on said three panels to represent a given time.

2. The mayan symbol-bearing clock device of claim 1 wherein said illuminatable means are at least one of incandescent lamps, liquid crystal display means and light emitting diode means.

3. The mayan symbol-bearing clock device of claim 1 wherein said power means comprise at least one of wiring interconnecting said clock with a source of electrical house current and batteries.

4. The mayan symbol-bearing clock device of claim 1 wherein said clock device includes in said housing a temperature measuring and mayan symbol display device.

5. The clock device of claim 4, wherein, (a) said temperature measuring and display device includes fourth, fifth and sixth display panels, each of which bear thereon electriclly illuminatable means bearing Mayan symbols for denoting numerical values, (b) said fourth panel including two rows of symbols, in which (1) the first row contains a "minus" sign, and (2) the second row contains a single dot which denotes a numerical value of one, (c) said fifth panel including three rows of symbols, in which (1) the first row contains a "plus" sign, (2) the second row contains four dots with each dot denoting numerical value of one, and (3) the third row contains a single, horizontal bar denoting a numerical value of five, and (d) said sixth panel including three rows of symbols, in which (1) the first row contains an inverted V symbol to denote zero, (2) the second row contains four dots with each dot denoting a numerical value of one, and (3) the third row contains a single, horizontal bar denoting a numerical value of five.

6. The mayan symbol-bearing clock devices of claim 5 wherein said clock device includes a temperature measuring and signal generating mechanism in said housing connected to said power means and said illuminatable temperature display means.

7. The mayan symbol-bearing clock device of claim 6 wherein said clock device indludes switch means for selectively displaying the time or the temperature.

8. The mayan symbol-bearing clock device of claim 7 wherein said switch and said display panels are mounted on the top of said housing, wherein said device is powered by electrical house current and wherein an AC-to-DC converter is interposed between said house current and said clock timing and temperature measuring mechanisms.

9. The mayan symbol-bearing clock device of claim 8 wherein said temperature display panels display a range of temperatures between −199° and +199°, said fourth, fifth and sixth panels indicating, respectively, the temperature in hundreds, tens and single temperature units.

10. The mayan symbol-bearing clock device of claim 4 wherein said temperature measuring and mayan symbol display device utilizes selected ones of said symbols of said first, second and third display panels to indicate temperature.

* * * * *